US012157963B2

(12) United States Patent
Thammavongsa

(10) Patent No.: US 12,157,963 B2
(45) Date of Patent: Dec. 3, 2024

(54) FLORAL SEWING NEEDLE ASSEMBLY

(71) Applicant: Marissa Thammavongsa, Escondido, CA (US)

(72) Inventor: Marissa Thammavongsa, Escondido, CA (US)

( * ) Notice: Subject to any disclaimer, the term of this patent is extended or adjusted under 35 U.S.C. 154(b) by 252 days.

(21) Appl. No.: 17/725,200

(22) Filed: Apr. 20, 2022

(65) Prior Publication Data

US 2023/0340710 A1 Oct. 26, 2023

(51) Int. Cl.
*D05B 85/00* (2006.01)
*A41G 1/04* (2006.01)
*D05B 97/00* (2006.01)

(52) U.S. Cl.
CPC ..... *D05B 85/00* (2013.01); *A41G 1/04* (2013.01); *D05B 97/00* (2013.01)

(58) Field of Classification Search
CPC ..... D05B 85/02; D05B 85/00; B21G 1/02
USPC ..... 223/102
See application file for complete search history.

(56) References Cited

U.S. PATENT DOCUMENTS

| | | | | |
|---|---|---|---|---|
| 1,943,174 | A | 1/1934 | Gagnon | |
| 2,284,274 | A | 5/1942 | Fridolph | |
| 2,526,104 | A | 10/1950 | Yamamoto | |
| 2,785,644 | A | 3/1957 | Freedle | |
| 2,872,092 | A * | 2/1959 | Sehlow | D05B 85/02 223/102 |
| 4,667,860 | A * | 5/1987 | Feuerman | D05B 85/00 223/102 |
| 6,006,965 | A * | 12/1999 | Hamann | D05B 85/00 223/102 |
| 6,189,747 | B1 | 2/2001 | Collingham | |
| 6,520,389 | B1 | 2/2003 | Bowman | |
| 8,151,720 | B2 | 4/2012 | Turner | |
| 10,047,464 | B2 * | 8/2018 | Hiza | D05B 85/02 |
| D851,907 | S | 6/2019 | Hiza | |
| 2017/0284004 | A1 * | 10/2017 | Hiza | B21G 1/02 |
| 2023/0323580 | A1 * | 10/2023 | Davis | D05B 85/00 112/222 |
| 2023/0340710 | A1 * | 10/2023 | Thammavongsa | D05B 97/00 |

FOREIGN PATENT DOCUMENTS

| | | |
|---|---|---|
| WO | WO2010105264 | 9/2010 |

* cited by examiner

*Primary Examiner* — Danny Worrell

(57) ABSTRACT

A floral sewing needle assembly for sewing flower petals into a garland includes a sewing needle that has a diameter being no greater than 0.81 mm. In this way the sewing needle can pierce a flower petal without damaging the flower petal. The sewing needle has a length of at least 233.0 mm to facilitate a plurality of flower petals to be positioned on the sewing needle.

11 Claims, 4 Drawing Sheets

FLORAL SEWING NEEDLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sewing needle device and more particularly pertains to a new sewing needle device for sewing flower petals into a garland. The device includes a sewing needle which has a length of at least 233.0 mm and a diameter of no more than 0.81 mm. The sewing needle has a tapered portion and a non-tapered portion, and the tapered portion is graduated between a fine point and a diameter that is less than the non-tapered portion.

(2) Description of Related Art Including Information Disclosed Under 37 CFR 1.97 and 1.98

The prior art relates to sewing needle devices including an upholstery needle which has a hooked and a recess integrated into an outer surface of the upholstery needle. The prior art discloses a lei needle which has a curved end to define a hook and a groove for accommodating the hook. The prior art discloses a tufting needle which has a central member that slidably engages an outer sleeve. The prior art discloses a sewing needle which has a pair of pointed ends and an eye that is centrally positioned between the pointed ends. The prior art discloses a quilting needle which includes a roughened portion for enhancing gripping. The prior art discloses a sewing needle which has an open eye for enhancing threading the eye. The prior art discloses an ornamental design of a sewing needle having periodic markings.

BRIEF SUMMARY OF THE INVENTION

An embodiment of the disclosure meets the needs presented above by generally comprising a sewing needle that has a diameter being no greater than 0.81 mm. In this way the sewing needle can pierce a flower petal without damaging the flower petal. The sewing needle has a length of at least 233.0 mm to facilitate a plurality of flower petals to be positioned on the sewing needle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
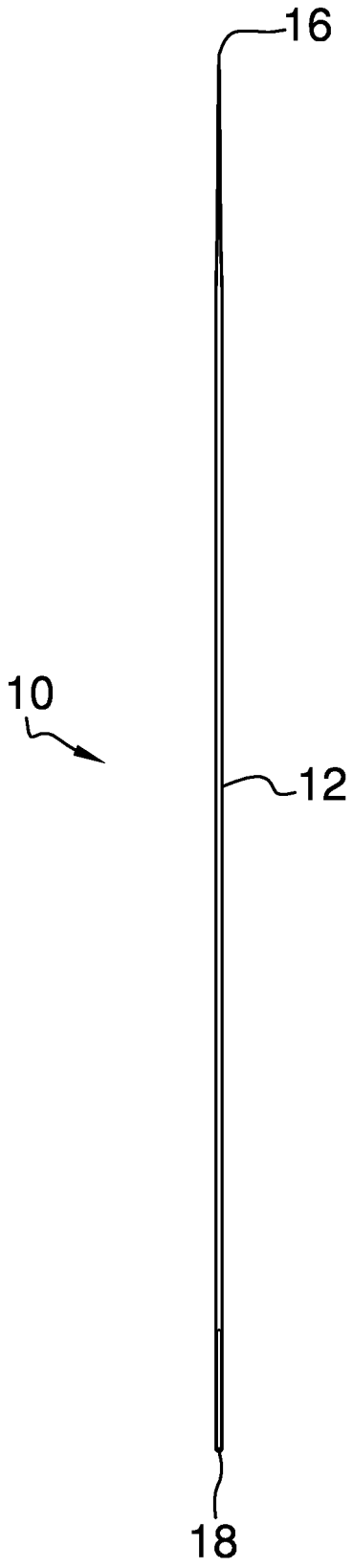
FIG. 1 is a right side view of a floral sewing needle assembly according to an embodiment of the disclosure.
Figure 2:
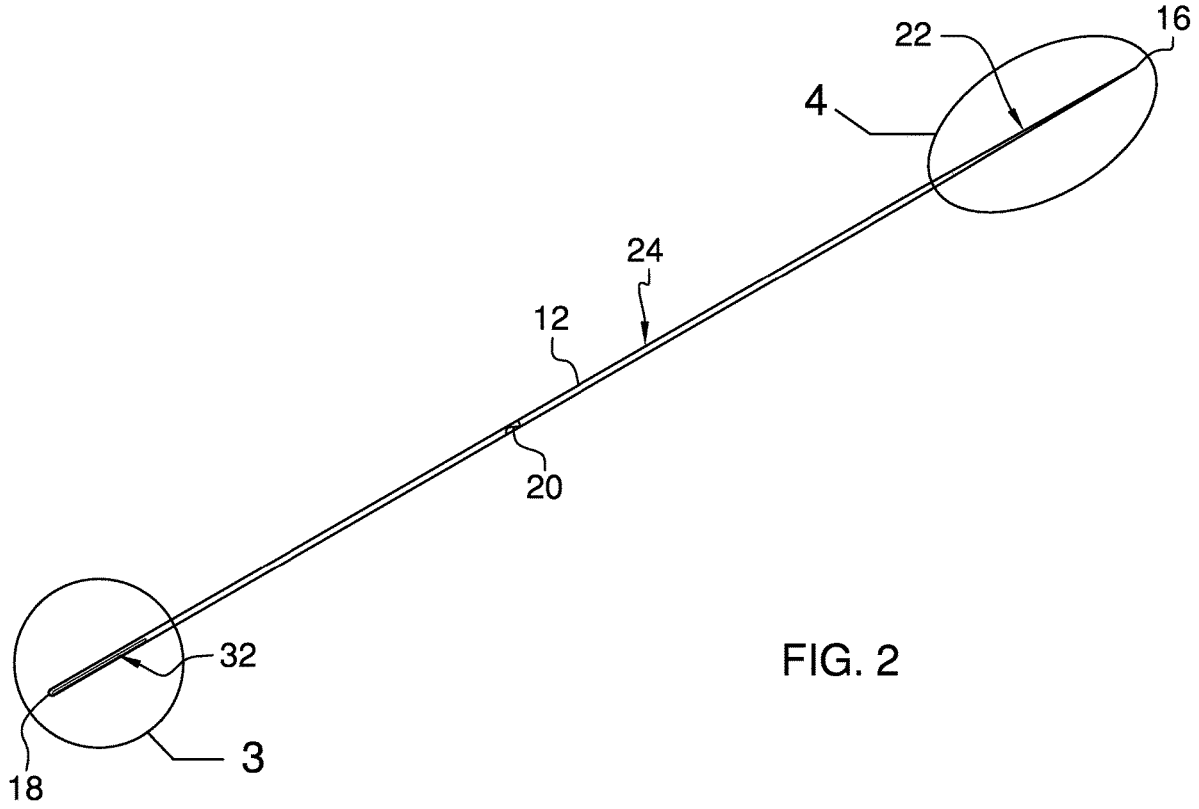
FIG. 2 is a perspective view of an embodiment of the disclosure.
Figure 3:
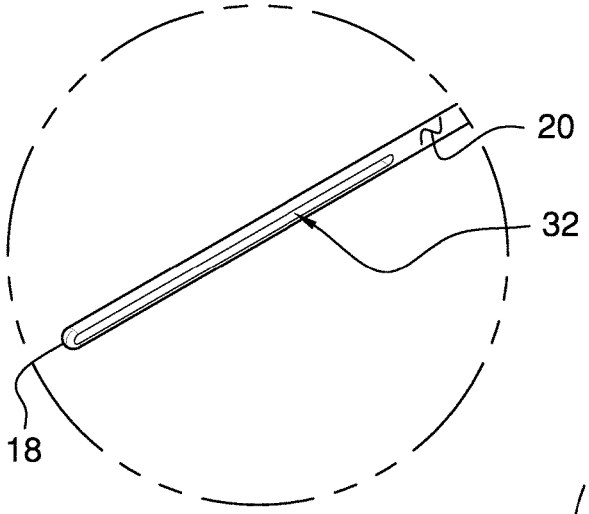
FIG. 3 is a detail view taken from circle 3 of FIG. 2 of an embodiment of the disclosure.
Figure 4:
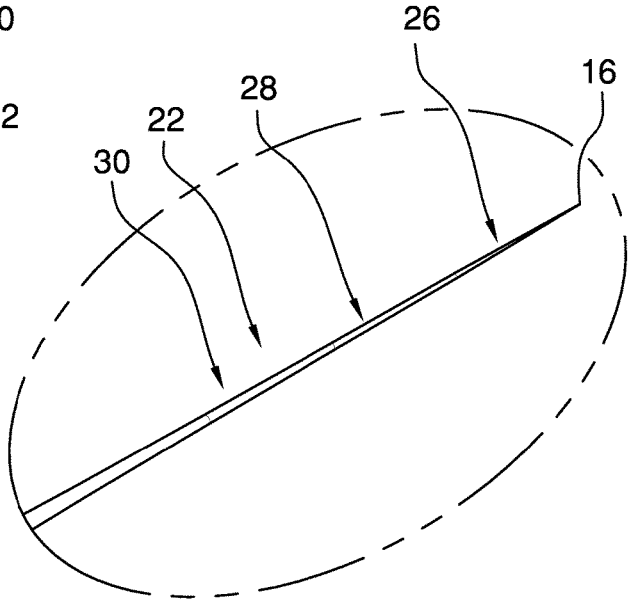
FIG. 4 is a detail view taken from circle 4 of FIG. 2 of an embodiment of the disclosure.
Figure 5:
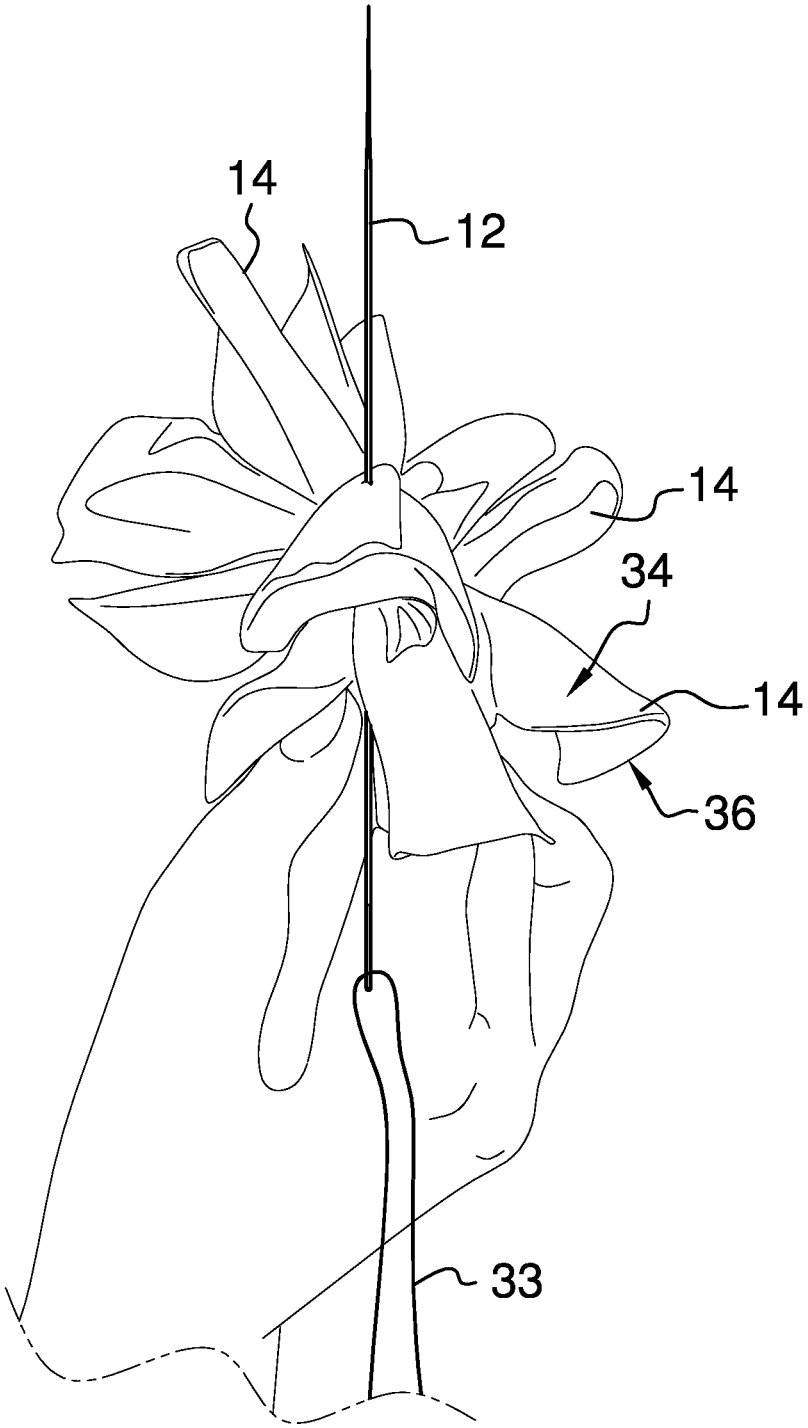
FIG. 5 is a perspective in-use view of an embodiment of the disclosure.

With reference now to the drawings, and in particular to FIGS. 1 through 5 thereof, a new sewing needle device embodying the principles and concepts of an embodiment of the disclosure and generally designated by the reference numeral 10 will be described.

As best illustrated in FIGS. 1 through 5, the floral sewing needle assembly 10 generally comprises a sewing needle 12 that has a diameter which is no greater than 0.81 mm. In this way the sewing needle 12 can pierce a flower petal 14 without damaging the flower petal 14. The flower petal 14 may be a rose petal, an iris petal or any other flower petal. The sewing needle 12 has a length of at least 233.0 mm to facilitate a plurality of the flower petals 14 to be positioned on the sewing needle 12.

The sewing needle 12 has a first end 16, a second end 18 and an outer surface 20 extending between the first end 16 and the second end 18, and the outer surface 20 has a tapered portion 22 extending from the first end 16 toward the second end 18. Furthermore, the outer surface 20 has a non-tapered portion 24 extending between the tapered portion 22 and the second end 18. The tapered portion 22 tapers to a fine point at the first end 16. The tapered portion 22 has a first section 26, a second section 28 and a third section 30.

The first section 26 extends from the first end 16 toward the non-tapered portion 24, and the second section 28 extends from the first section 26 toward the non-tapered portion 24. The third section 30 extends between the second section 28 and the non-tapered portion 24. The first section 26 has a maximum diameter which is less than a minimum diameter of the second section 28. Moreover, the maximum diameter of the first section 26 may be no more than 0.34 mm. The second section 28 has a maximum diameter is less than a minimum diameter of the third section 30. The maximum diameter of the second section 28 may be no more than 0.45 mm. Continuing, the third section 30 has a maximum diameter which is less than a diameter of the non-tapered portion 24. The maximum diameter of the third section 30 may be no more than 0.6 mm.

The sewing needle 12 has a hole 32 extending through the outer surface 20. In this way thread 33 can be extended through the hole 32. The hole 32 is positioned adjacent to the second end 18. Furthermore, the hole 32 is elongated along an axis extending between the first end 16 and the second end 18 such that the hole 32 has an ovoid shape. Each of the first section 26, the second section 28 and the third section 30 may have a length of at least 1.0 cm. The non-tapered portion 24 of the sewing needle 12 may have a length of at least 19.5 cm. Furthermore, the hole 32 may have a length of approximately 2.0 cm and a maximum diameter of no more than 0.0527 mm.

In use, the sewing needle 12 is threaded and a respective one of the flower petals 14 is folded along a longitudinal axis of the flower petal 14 to define a first portion 34 and a second portion 36 of the flower petal 14. The first portion 34 and the second portion 36 are pinched together at a respective end of the flower petal 14. The sewing needle 12 is extended through the flower petal 14 where the first portion 34 and the second portion 36 are pinched together. The aforementioned process is repeated until all of the flower petals 14 are positioned on the sewing needle 12. The plurality of flower petals 14 are arranged on the sewing needle 12 into a preferred arrangement. Continuing, the sewing needle 12 is pulled through the plurality of flower petals 14 until the plurality of flower petals 14 are positioned on the thread 33. The aforementioned process is repeated as many times as necessary in order to build a garland of flower petals 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A floral sewing needle assembly having a diameter being sufficiently small to pierce a flower petal without damaging the flower petal and having a length being sufficient to hold a plurality of flower petals, said assembly comprising:

a sewing needle having a diameter being no greater than 0.81 mm wherein said sewing needle is configured to pierce a flower petal without damaging the flower petal, said sewing needle having a length of at least 233.0 mm wherein said sewing needle is configured to facilitate a plurality of flower petals to be positioned on said sewing needle;

wherein said sewing needle has a first end, a second end and an outer surface extending between said first end and said second end, said outer surface having a uniform un-patterned appearance between said first end and said second end;

wherein said outer surface having a tapered portion extending from said first end toward said second end;

wherein said outer surface has a non-tapered portion extending between said tapered portion and said second end; and wherein said tapered portion tapers to a fine point at said first end.

2. The assembly according to claim 1, wherein said tapered portion has a first section, a second section and a third section.

3. The assembly according to claim 2, wherein said first section extends from said first end toward said non-tapered portion.

4. The assembly according to claim 2, wherein said second section extends from said first section toward said non-tapered portion.

5. The assembly according to claim 2, wherein said third section extends between said second section and said non-tapered portion.

6. The assembly according to claim 2, wherein said first section has a maximum diameter being less than a minimum diameter of said second section.

7. The assembly according to claim 2, wherein said second section has a maximum diameter being less than a minimum diameter of said third section.

8. The assembly according to claim 2, wherein said third section has a maximum diameter being less than a diameter of said non-tapered portion.

9. The assembly according to claim 1, wherein said sewing needle has a hole extending through said outer surface wherein said hole is configured to have thread extended through said hole.

10. The assembly according to claim 9, wherein said hole being positioned adjacent to said second end, said hole being elongated along an axis extending between said first end and said second end such that said hole has an ovoid shape.

11. A floral sewing needle assembly having a diameter being sufficiently small to pierce a flower petal without damaging the flower petal and having a length being sufficient to hold a plurality of flower petals, said assembly comprising:

a sewing needle having a diameter being no greater than 0.81 mm wherein said sewing needle is configured to pierce a flower petal without damaging the flower petal, said sewing needle having a length of at least 233.0 mm wherein said sewing needle is configured to facilitate a plurality of flower petals to be positioned on said sewing needle, said sewing needle having a first end, a second end and an outer surface extending between said first end and said second end, said outer surface having a uniform un-patterned appearance between said first end and said second end, said outer surface having a tapered portion extending from said first end toward said second end, said outer surface having a non-tapered portion extending between said tapered portion and said second end, said tapered portion tapering to a fine point at said first end, said tapered portion having a first section, a second section and a third section, said first section extending from said first end toward said non-tapered portion, said second section extending from said first section toward said non-tapered portion, said third section extending between said second section and said non-tapered portion, said first section having a maximum diameter being less than a minimum diameter of said second section, said second section having a maximum diameter being less than a minimum diameter of said third section, said third section having a maximum diameter being less than a diameter of said non-tapered portion, said sewing needle having a hole extending through said outer surface wherein said hole is configured to have thread extended through said hole, said hole being positioned adjacent to said second end, said hole being elongated along an axis extending between said first end and said second end such that hole said has an ovoid shape.

* * * * *